United States Patent [19]

Rossiter

[11] Patent Number: 4,542,885

[45] Date of Patent: Sep. 24, 1985

[54] METAL FENCE POST

[76] Inventor: Thomas E. Rossiter, 2918 Rolling Hills, Carrollton, Tex. 75007

[21] Appl. No.: 673,990

[22] Filed: Nov. 21, 1984

[51] Int. Cl.[4] ..... E04H 17/14

[52] U.S. Cl. ..... 256/69; 256/55; 256/DIG. 5

[58] Field of Search ..... 256/59, 65, 66, 68, 256/68, DIG 5, 55

[56] References Cited

U.S. PATENT DOCUMENTS

| | | | |
|---|---|---|---|
| 185,022 | 12/1876 | Fitts | 256/59 |
| 196,175 | 10/1877 | Willcuts | 256/DIG. 5 |
| 917,083 | 4/1909 | Kyle | 256/65 X |
| 1,643,555 | 9/1927 | Gledhill | 256/69 X |
| 3,195,864 | 7/1965 | Case | 256/65 |
| 4,140,298 | 2/1979 | Coleman, Jr. | 256/65 |
| 4,369,953 | 1/1983 | Greiner | 256/65 X |

*Primary Examiner*—Andrew V. Kundrat

[57] ABSTRACT

This metal fence post is designed to receive wooden fence rails, and will support them within its openings, until the installer is ready to fasten the rails securely in place. Primarily, it consists of a metal channel, having side openings at various levels, for freely receiving fence rails. It further includes openings in its flanges, for receiving screws to fasten the rails therein.

1 Claim, 6 Drawing Figures

FIG. 1
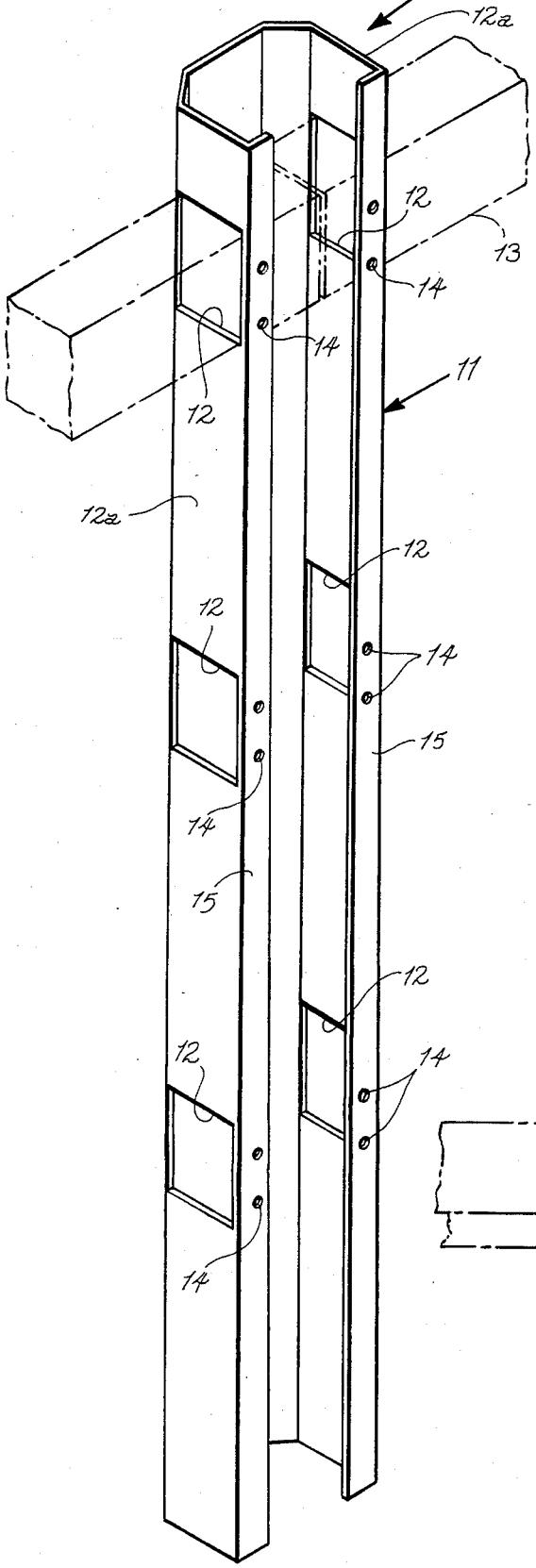
FIG. 2
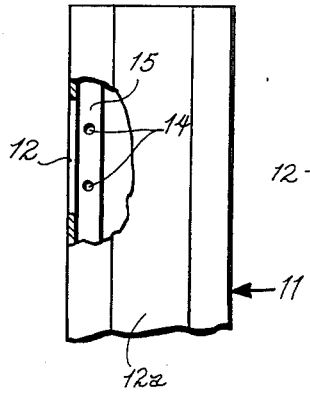
FIG. 3
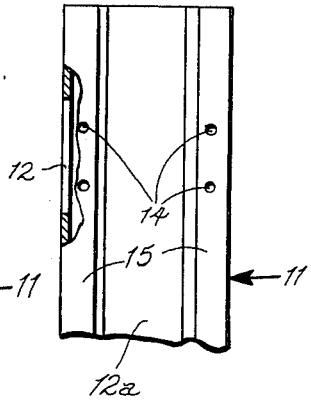
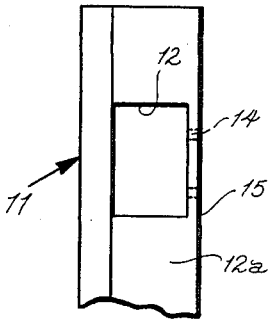
FIG.4
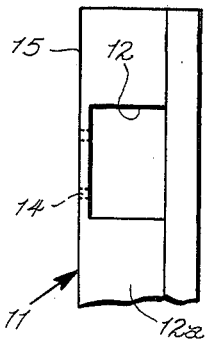
FIG.5
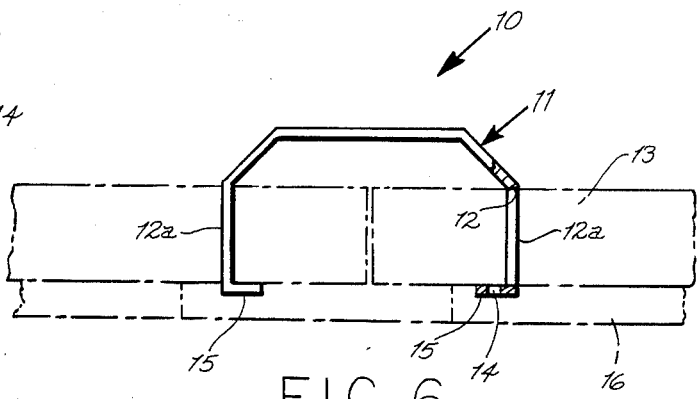
FIG. 6

METAL FENCE POST

This invention relates to fencing, and more particularly, to a metal fence post.

The principal object of this invention is to provide a metal fence post, which will be fabricated in one piece, and will require no extra components.

Another object of this invention is to provide a metal fence post, which will be easier to use than such posts of the prior art, and may be fabricated for four to eight foot fences, employing wood fencing rails.

A further object of this invention is to provide a metal fence post, which will be of such design, as to retain a fencing rail in place until it is fastened thereto.

Other objects are to provide a metal fence post, which is simple in design, inexpensive to manufacture, rugged in construction, easy to use, and efficient in operation.

These, and other objects, will be readily evident, upon a study of the following specification, and the accompanying drawing, wherein:

FIG. 1 is a perspective view of the present invention, showing a fence rail fragmentary, and in phantom lines;

FIG. 2 is a fragmentary front elevational view of FIG. 1, shown partly broken away, with the rail removed therefrom;

FIG. 3 is a fragmentary rear elevational view of the invention, shown partly broken away;

FIG. 4 is a fragmentary left side elevational view of FIG. 1, showing the rail removed therefrom;

FIG. 5 is similar to FIG. 4, but shows the right side of FIG. 1, and FIG. 6 is a top plan view of the invention, shown partly broken away, and illustrating fencing rails in phantom lines.

Accordingly, a post 10 is shown to consist of an extruded channel 11. A plurality of equally spaced and rectangular openings 12 are provided through the side walls 12*a*, for receiving and retaining fence rails 13, which will be properly secured later on. The design is such, that the rails 13 abut with each other when placed in the openings 12, and openings 14 are provided through the flanges 15 of post 10, so as to secure the rails 13 therein. The pickets 16 are then added thereto, for the completed construction.

In use, the posts 10 are placed equally spaced within the ground, and the rails 13 are entered into the rectangular openings 12 therethrough, where they abut with each other, and remain in place until it is desired to secure them by means of screw fasteners being entered into the openings 14 and into the rails 13.

While various changes may be made in the detail construction, it is understood that such changes will be within the spirit and scope of the present invention, as is defined by the appended claims.

What I claim is:

1. A fence post, comprising, in combination, an upright channel, and rectangular rails supported in said channel; said channel being made of extruded metal, configurated around a central opening and being of generally "U"-shaped cross-sectional configuration by including a pair of opposite side walls and an interconnecting end wall between one side end thereof, and a pair of flanges formed between opposite side ends thereof; a plurality of equally spaced apart rectangular openings through each said side wall, said rectangular openings in one said side wall being aligned with said rectangular openings of the other said side wall; each said rectangular opening receiving one said rail therethrough, ends of said rails in aligned pairs of said openings being abutted together, and a plurality of pairs of mounting openings along each said flange receiving screw fasteners screwed into a side of said rails.

* * * * *